United States Patent [19]

Norimatsu et al.

[11] 4,143,623

[45] Mar. 13, 1979

[54] AIR-TO-FUEL RATIO FEEDBACK CONTROL SYSTEM FOR INTERNAL COMBUSTION ENGINES

[75] Inventors: Hideaki Norimatsu; Mitsuo Nakamura, both of Kariya, Japan

[73] Assignee: Nippondenso Co., Ltd., Kariya, Japan

[21] Appl. No.: 794,930

[22] Filed: May 9, 1977

[30] Foreign Application Priority Data

Jun. 18, 1976 [JP] Japan ..... 51-72527

[51] Int. Cl.[2] ..... F02B 3/08; F02M 7/12; F01N 3/08

[52] U.S. Cl. ..... 123/32 EE; 123/32 EL; 123/32 EH; 60/285; 60/276; 123/119 EC

[58] Field of Search ..... 123/32 EE, 32 EH, 32 EL, 123/32 EA, 119 EC; 60/276, 285

[56] References Cited

U.S. PATENT DOCUMENTS

| | | | |
|---|---|---|---|
| 3,720,191 | 3/1973 | Rachel | 123/32 EL |
| 3,875,907 | 4/1975 | Wessel et al. | 123/32 EE |
| 3,916,170 | 10/1975 | Norimatsu et al. | 123/32 EE |
| 3,926,153 | 12/1975 | Reddy | 123/32 EL |
| 3,939,654 | 2/1976 | Creps | 60/285 |
| 3,986,352 | 10/1976 | Casey | 60/285 |

*Primary Examiner*—Charles J. Myhre
*Assistant Examiner*—P. S. Lall
*Attorney, Agent, or Firm*—Cushman, Darby & Cushman

[57] ABSTRACT

In an air-to-fuel ratio feedback control system, air-to-fuel ratio of mixture supplied to an engine is controlled to be stoichiometric in response to the oxygen concentration in exhaust gases during normal operating conditions of the engine, whereas it is controlled irrespective of the oxygen concentration during specific operating conditions such as heavy load and no load conditions of the engine. Sensor output signal indicative of the oxygen concentration which is integrated to control the air-to-fuel ratio is cut off and integrator output signal is increased or decreased by a predetermined value during the specific conditions so that the mixture is controlled to be richer or leaner as desired than the stoichiometry.

7 Claims, 2 Drawing Figures

AIR-TO-FUEL RATIO FEEDBACK CONTROL SYSTEM FOR INTERNAL COMBUSTION ENGINES

BACKGROUND OF THE INVENTION

The present invention is related to an air-to-fuel ratio feedback control system, and more particularly to a system wherein air-fuel mixture is controlled as desired during specific operating conditions of engine.

Various types of air-to-fuel ratio feedback control system in which air-fuel mixture is controlled to the stoichiometric mixture in response to the oxygen concentration in exhaust gases are known well in the art. One exemplary system is disclosed in the U.S. Pat. No. 3,745,768 in which air and/or fuel of air-fuel mixture are/is feedback-controlled in response to the oxygen concentration. Another exemplary system is disclosed in the U.S. Pat. No. 3,916,170 in which the air-fuel mixture is corrected in proportion to the difference between integrator output level and a preset constant level so that the air or the fuel is increased or decreased. These feedback control system has a disadvantage in that the air-fuel mixture is constantly kept at the stoichiometric mixture contrary to such a requirement as that richer or leaner mixture than the stoichiometric mixture must be supplied to an engine during respective heavy load such as accelerating or no load such as decelerating condition.

SUMMARY OF THE INVENTION

It is therefore a primary object of the invention to provide a system in which air-fuel mixture is controlled to be richer or leaner than the stoichiometry during specific operating conditions of an engine.

It is another object of the invention to provide a system in which sensor output indicative of the oxygen concentration is integrated to correct the air-to-fuel ratio of mixture during normal operating conditions and integrator output is increased or decreased by a predetermined value cutting off the sensor output during specific operating conditions.

It is a further object of the invention to provide a system in which air-fuel mixture is controlled to be richer or leaner than the stoichiometry during respective accelerating or decelerating condition.

DESCRIPTION OF THE PREFERRED EMBODIMENT

Figure 1:
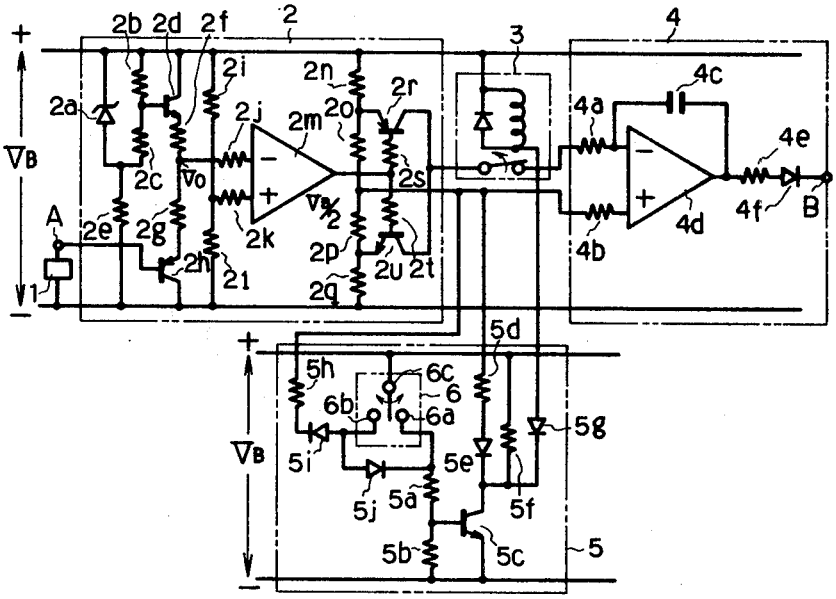
FIG. 1 is an electric wiring diagram of an embodiment of an air-to-fuel ratio feedback control system according to the present invention.
Figure 2:
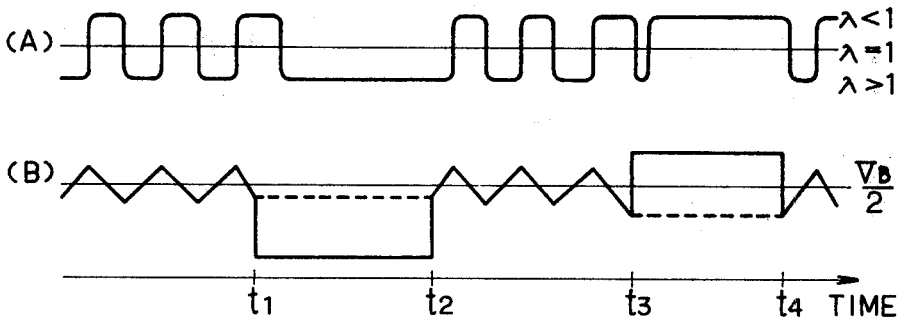
FIG. 2 is a chart of signal waveforms (A) and (B) generated by the oxygen sensor and the integrator circuit shown in FIG. 1.

A system according to the present invention is described hereinunder with respect to the embodiment shown in FIGS. 1 and 2.

In FIG. 1 illustrating a detail construction of a feedback circuit which feeds back oxygen concentration in exhaust gases to a mixture supply controller, numeral 1 denotes an oxygen sensor positioned in the exhaust passage of an engine (not shown) for sensing the oxygen concentration in the exhaust gases. The oxygen sensor 1 is connected to a comparator circuit 2 which compares the sensor output level with a preset constant level to reshape the sensor output signal into a rectangular signal, and the comparator circuit 2 is connected via an integration control circuit 3 to an integrator circuit 4 which integrates the rectangular comparator output signal with respect to the time. The integration control circuit 3 is connected to cut off the application of the comparator output signal during preselected specific operating conditions of the engine. Connected to the integration control circuit 3 is an integration hold circuit 5 which is adapted to detect both full opening and closing of the throttle valve of the engine and concurrently increase or decrease the integrator output signal by a predetermined value.

The comparator circuit 2 is comprised of a Zener diode 2*a*, resistors 2*b*, 2*c*, 2*e*, 2*f*, 2*g*, 2*i*, 2*j*, 2*k*, 2*l*, 2*n*, 2*o*, 2*p*, 2*q*, 2*s* and 2*t*, transistors 2*d*, 2*h*, 2*r* and 2*u* and a comparator 2*m*. Between the oxygen sensor 1 and the comparator 2*m*, a bridge circuit having four arms is connected. The first arm (2*d* and 2*f*) and the second arm (2*g* and 2*h*) are connected to be supplied with a source voltage $V_B$ thereacross so that a voltage signal $V_0$ at the junction of the first and second arms is applied to the inverting input (−) of the comparator 2*m*, whereas the third arm (2*i*) and the fourth arm (2*l*) are connected in series to be supplied with the source voltage $V_B$ thereacross so that a constant voltage signal $V_{B/2}$ at the junction of the third and fourth arms is supplied to the non-inverting input (+) of the comparator 2*m*. The base potential of the transistor 2*d* is kept constant by the Zener diode 2*a* and the resistors 2*b* and 2*c*, whereas the base potential of the transistor 2*h* is varied in response to the change of the sensor output signal. As is known well in the art that the sensor output signal becomes high and low in response to the respective absence and the presence of oxygen in the exhaust gases. It should be understood herein that the absence and the presence of oxygen in the exhaust gases represent respectively that the air-fuel mixture is richer ($\lambda<1$) than the stoichiometry ($\lambda=1$) and that the air-fuel mixture is leaner ($\lambda>1$) than the stoichiometry. According to this construction, therefore, the signal $V_0$ becomes lower than the value $V_{B/2}$ when the sensor 1 generates a low output signal which renders the transistor 2*h* conductive, but it becomes higher than the value $V_{B/2}$ when the sensor 1 generates a high output signal which renders the transistor 2*h* nonconductive. The constant signal level $V_{B/2}$ is preset to correspond to the stoichiometric ratio ($\lambda=1$) of air-fuel mixture. The comparator 2*m*, as a result, generates a high level signal and a low level signal respectively when the voltage signal $V_0$ is lower and higher than the constant level $V_{B/2}$, thus reshaping the sensor output signal into the rectangular comparator output signal. The transistors 2*r* and 2*u* are connected to the output of the comparator 2*m* in such a manner that the transistor 2*r* (PNP) is rendered conductive only while the rectangular signal level is kept low and the transistor 2*u* (NPN) is rendered conductive only while the rectangular signal level is kept high.

The integration control circuit 3 is comprised of a relay which is adapted to open the contact thereof only when the coil thereof is kept conductive.

The integrator circuit 4 is comprised of resistors 4*a*, 4*b* and 4*e*, a capacitor 4*c*, an operational amplifier 4*d* and a diode 4*f*. Connected to the inverting input (−) through the resistor 4*a* and the non-inverting input (+) through the resistor 4*b* are the collector junction of the transistors 2*r* and 2*u* and the junction of the resistors 2*o* and 2p, respectively. The resistors 2n, 2o, 2p and 2q are adapted to supply a constant voltage signal $V_{B/2}$ at the junction connected to the resistor 4b. Assuming that the relay of the integration control circuit 3 is closed, the integrating direction is reversed by the level change of the rectangular signal applied to the transistors 2r and 2u. An integrating current flows from the integrator circuit 4 to the comparator circuit 2 during the conduction of the transistor 2u, whereas it flows from the comparator circuit 2 to the integrator 4 during the conduction of the transistor 2r. The operational amplifier 4d, controlling the charge and discharge of the capacitor 4c in response to the integrating current, generates the output voltage signal which gradually increases and decreases during respective conductions of the transistors 2u and 2r. It should be noted herein that the opening of the relay in the integration control circuit 3 cuts off the integrating current, resulting in holding the output signal of the integrator circuit 4.

The integration hold circuit 5 is comprised of a well-known throttle switch 6, resistors 5a, 5b, 5d, 5f and 5h, a transistor 5c and diodes 5e, 5g, 5i and 5j. The throttle switch 6 is coupled to the throttle valve of the engine in such a manner that a movable contact 6c is moved to contact with a stationary contact 6a during the full closing of the throttle valve and that it is moved to contact with another stationary contact 6b during the full opening of the throttle valve. The transistor 5c is adapted to be rendered conductive while the movable contact 6c is kept in contact with either stationary contact 6a or 6b. The transistor 5c is connected to the integration control circuit 3 through the diode 5g to thereby open the relay during the conduction thereof and further connected to the integrator circuit 4 through the resistor 5d and the diode 5e to thereby decrease the noninverting input voltage signal of the operational amplifier 4d. The stationary contact 6b of the throttle switch 6 is connected to the integrator circuit 4 through the resistor 5h and the diode 5i to thereby increase the noninverting input voltage signal of the operational amplifier 4d.

The overall operation of the system is described hereinunder with reference to the signal waveforms shown in FIG. 2, assuming that the output signal of the integrator circuit 4 is applied to the mixture supply controller (not shown) adapted to correct either air or fuel of air-fuel mixture in proportion to the integrator output signal.

During the normal operating condition of the engine, the throttle valve is opened intermediately between the full opening and closing positions and the transistor 5c is kept nonconductive. The sensor output signal applied to a terminal A alternately changes high and low within a short period as shown in (A) of FIG. 2 and reshaped into the rectangular signal by the comparator circuit 2. It must be recalled that the rectangular signal has constant high and low levels while the presence and the absence of the oxygen is detected by the oxygen sensor 1, respectively. the comparator output signal having rectangular waveform is integrated by the integrator circuit 4 with respect to time when it is passed through the integration control circuit 3. The integrator output signal appearing at a terminal B, therefore, increases and decreases alternately as the time passes as shown in (B) of FIG. 2. The changing direction of the integrator output signal is reversed in synchronized relationship with the level change of the sensor output signal. Provided that the mixture supply controller corrects fuel amount, the fuel supply amount is decreased gradually while the integrator output signal is kept decreasing, whereas it is increased gradually while the integrator output signal is kept increasing. Thus correcting the fuel amount in response to the integrator output signal corresponding to the oxygen concentration in the exhaust gases, the air-to-fuel ratio of mixture is controlled to be stoichiometric.

It is assumed herein that the throttle valve is fully closed for decelerating the engine from the time $t_1$ until the time $t_2$. On this occasion the throttle switch 6 renders the transistor 5c conductive, keeping the movable contact 6c in contact with the stationary contact 6a. The transistor 5c then opens the relay of the integration control circuit 3 which in turn cuts off the comparator output signal to prevent the integrating operation of the integrator circuit 4. The integrator output signal is thus supposed to be unchanged as shown by the dotted line in (B) of FIG. 2. The transistor 5c at the same time $t_1$ decreases the non-inverting input (+) signal level of the operational amplifier 4d of the integrator circuit 4 by the predetermined value as shown by the solid line in (B) of FIG. 2. The integrator output signal, as a result, is held unchanged at a value lower than the constant level $V_{B/2}$. Receiving this integrator output signal, the mixture supply controller decreases fuel amount so that the air-fuel mixture which is leaner than the stoichiometry is supplied to the engine. When the throttle valve is opened again from the fully closed position at the time $t_2$, the relay of the integration control circuit 3 are closed to pass the comparator output signal and the noninverting input signal of the operational amplifier 4d is returned to the constant level $V_{B/2}$. The integrator output signal is thus returned to the same level as of the time $t_1$. After the return at the time $t_2$ the integration output signal changes as the sensor output signal changes, and the air-to-fuel ratio is feedback-controlled to be stoichiometry as long as the throttle valve is opened intermediately.

It is further assumed herein that the throttle valve is fully opened for accelerating the engine or for the heavy load of the engine from the time $t_3$ until the time $t_4$. On this occasion the throttle switch 6 renders the transistor 5c conductive, keeping the movable contact 6c in contact with the stationary contact 6b. The integration control circuit 3 then cuts off the comparator output signal to hold the integration output signal as shown by the dotted line in (B) of FIG. 2. At the same time $t_3$ the non-inverting input signal of the integrator circuit 4 is increased by the predetermined value as shown by the solid line in (B) of FIG. 2. The integrator output signal, as a result, is held unchanged at a value higher than the constant voltage $V_{B/2}$. Receiving this integrator output signal, the mixture supply controller increases fuel amount so that the air-fuel mixture which is richer than the stoichiometry is supplied to the engine.

It must be understood in the abovedescribed embodiment that the air-to-fuel ratio is controlled not only to be richer or leaner than the stoichiometry during the full opening or closing of the throttle valve but also to return to the stoichiometry at the same time as the termination of the full opening or closing of the throttle valve.

Although the accelerating or decelerating condition of the engine is detected in view of the throttle valve movement in the embodiment described hereinabove, it may be detected in view of vacuum pressures, rotational speeds or air flow amounts of the engine as well.

We claim:

1. In combination with an engine having a mixture supply controller adapted to supply air-fuel mixture in accordance with the operating conditions of said engine, air-to-fuel ratio feedback control system comprising:

sensor means, positioned in the exhaust passage of said engine, for detecting the presence and absence of oxygen in exhaust gases;

integrator means, connected between said sensor means and said mixture supply controller, for generating an integrator output signal in response to which said mixture supply controller corrects the air-to-fuel ratio of said air-fuel mixture to be stoichiometric, said integrator output signal changing the output level thereof in response to the sensor output signal of said sensor means so long as said sensor output signal is applied;

detector means for detecting at least one of accelerating and decelerating conditions of said engine;

cut off means including a switching element which is rendered nonconductive by said detector means while said at least one condition is detected, said switching element cutting off said sensor output signal during nonconductive thereof so that said integrator output signal dependent on said sensor output signal of said sensor means is memorized; and control means responsive to said detector means for either increasing or decreasing said memorized integrator output signal by a predetermined value at the start of said at least one of conditions and for oppositely decreasing or increasing said increased or decreased integrator output signal by said predetermined value at the end of said at least one of conditions, whereby the air-to-fuel ratio of said air-fuel mixture is controlled at a value other than the stoichiometry in response to said increased or decreased integration output signal while said at least one of conditions is detected.

2. Air-to-fuel ratio feedback control system according to claim 1, wherein said integrator means includes:

an operational amplifier having a first input terminal to which said sensor output signal is applied through said cut-off means during the conduction of said switching element, and a second input terminal to which a constant level signal is applied, said second input terminal being connected to said control means so that said constant level signal is either increased or decreased by said control means to correspondingly increase of decrease said memorized integrator output signal by said predetermined value; and a capacitor connected between said first input terminal and the output terminal of said operational amplifier.

3. Air-to-fuel ratio feedback control system according to claim 1 further comprising:

comparator means, connected between said sensor means and said cut-off means, for reshaping said sensor output signal into a rectangular signal having a first and a second constant levels indicative of respective presence and absence of the oxygen.

4. Air-to-fuel ratio feedback control system according to claim 3, wherein said detector means includes:

a first switch for detecting the full opening of a throttle valve; and a second switch for detecting the full closing of said throttle valve.

5. Method for controlling the air-to-fuel ratio of air-fuel mixture comprising the steps of:

detecting the presence and the absence of oxygen in the exhaust gases of an engine;

discriminating whether the air-to-fuel ratio of air-fuel mixture supplied to said engine is richer or leaner than the stoichiometric ratio with reference to the result of said detecting step;

integrating the result of said discriminating step in proportion to the time so long as the result of said discriminating step is applied, the integrating direction being changed from one to the other directions between increasing and decreasing directions by the change of the result of said discriminating step;

detecting a preselected operating condition of said engine;

preventing the result of said discriminating step from being applied to said integrating step in response to said detecting step to thereby memorize the integration value of said integrating step at the start of said detecting step;

correcting the memorized integration value by a predetermined constant value during the detection of said operating condition, the corrected integration value having a predetermined difference from the memorized integration value;

returning the corrected integration value to the memorized integration value at the end of said detecting step;

correcting the air-to-fuel ratio of said air-fuel mixture which is to be supplied to said engine so that said air-fuel mixture is controlled to be either richer or leaner than the stoichiometric ratio in response to the corrected value of said correcting step during the detection of said operating condition and to be stoichiometric in response to the integration value of said integrating step during other operating conditions.

6. Method according to claim 5, wherein said detecting step includes the step of:

detecting a first operating condition in which said engine is subjected to the heavy load; and detecting a second operating condition in which said engine is subjected to the no load.

7. Method according to claim 6, wherein said two detecting steps include the step of detecting first and second operating conditions with reference to the movement of an throttle valve.

* * * * *